United States Patent [19]

Hammer

[11] Patent Number: 5,052,083

[45] Date of Patent: Oct. 1, 1991

[54] TIE BAND WITH DISPLAY

[76] Inventor: Charles P. Hammer, 1157 Marsh St., San Luis Obispo, Calif. 93401

[21] Appl. No.: 564,128

[22] Filed: Aug. 7, 1990

[51] Int. Cl.[5] ..... A41D 25/04

[52] U.S. Cl. ..... 24/49 R; 24/49 CF; 24/49 A; 24/50

[58] Field of Search ..... 24/49 CF, 49 R, 49 A, 24/49 K, 49 M, 49 CP, 49 CC, 50, 54

[56] References Cited

U.S. PATENT DOCUMENTS

| | | | |
|---|---|---|---|
| 1,990,720 | 2/1935 | White | 24/49 CF |
| 2,024,943 | 12/1935 | Mix | 24/49 CF |
| 2,059,301 | 11/1936 | Albright | 24/49 CF |
| 2,138,575 | 11/1938 | Gaynor | 24/49 CF |
| 2,181,443 | 11/1939 | Beman | 24/49 CF |
| 2,601,424 | 6/1952 | Baker | 24/49 M |
| 3,467,993 | 9/1969 | Smith | 24/50 |
| 3,827,108 | 8/1974 | Jewett | 24/49 CF |
| 4,835,821 | 6/1989 | Durante | 24/49 M |

*Primary Examiner*—Victor N. Sakran
*Attorney, Agent, or Firm*—Daniel C. McKown

[57] ABSTRACT

A tie band that can be attached to a button on the front of a shirt for holding a necktie of the four-in-hand type in a laterally-centered position against the front of the shirt while also displaying an emblem in front of the necktie includes a hidden patch that fastens to a button on the front of the shirt, a band attached to the hidden patch and encircling the necktie without gathering it and a display patch bearing the emblem to be displayed and attached to the band diametrically opposite the hidden patch so as to lie in front of the necktie.

4 Claims, 1 Drawing Sheet

Fig. 1
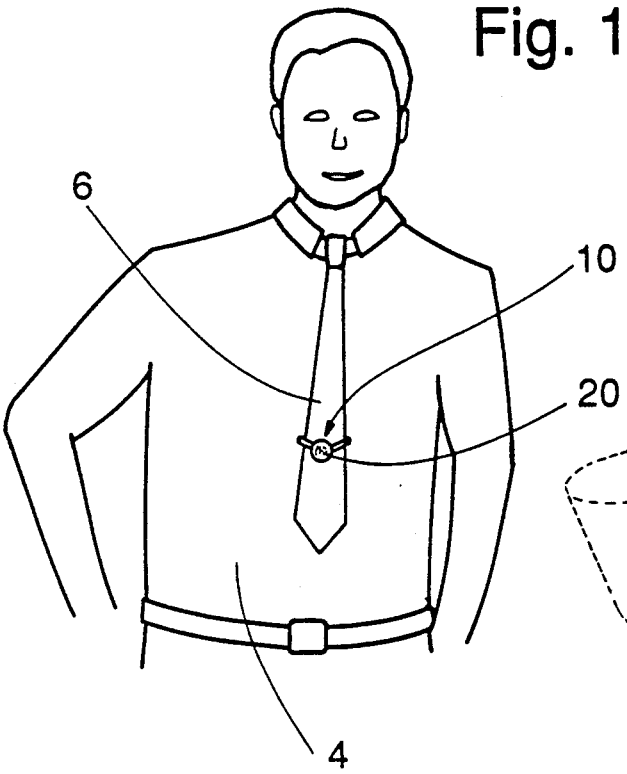
Fig. 2
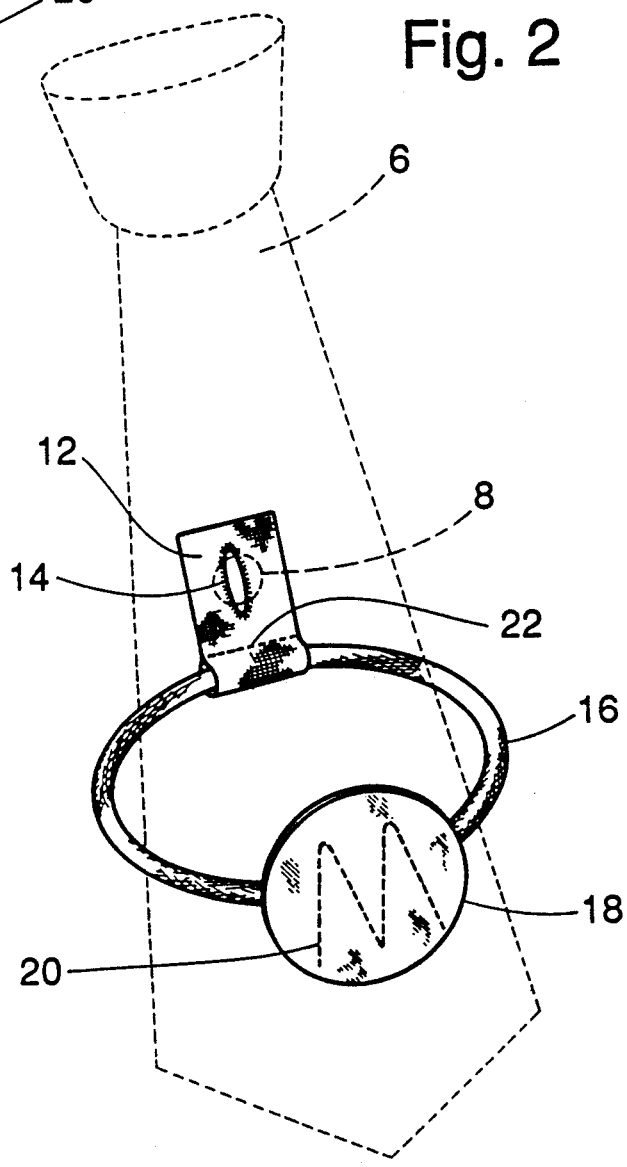
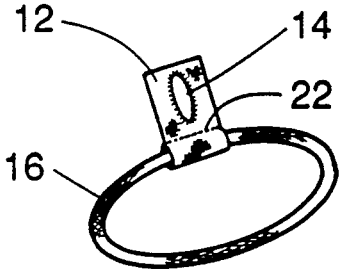
Fig. 3

TIE BAND WITH DISPLAY

The present invention is a tie band for use in holding a four-in-hand type of necktie in a laterally-central position against the front of a shirt while simultaneously displaying an emblem in front of the necktie.

A large number of patents have been issued for necktie clips and bands of various types. However, relatively few of these patents show the possibility of providing a display patch that bears an emblem.

In U.S. Pat. No. 2,029,597 issued Feb. 4, 1936, Thomas shows a tie holder that includes a fabric tab having a buttonhole to secure it to a shirt button. To this fabric tab is attached a metallic clasp that encircles the tie to hold it in place.

In U.S. Pat. No. 2,601,424 issued June 24, 1952, Baker shows the use of a magnet that clips to the front pleat of a shirt behind the tie in conjunction with an emblem-bearing magnet located on the front of the tie and held thereto by magnetic attraction.

In U.S. Pat. No. 3,827,108 issued to Jewett on Aug. 6, 1974 there is shown in FIG. 5 a helical necktie holder bearing an emblem.

All of these patents employ at least one rigid part and none of them has a structure similar to that of the present invention.

It is an object of the present invention to provide a tie band that is adapted for displaying an emblem as well as for holding a necktie in a central position against the shirt.

It is a further objective of the present invention to provide a tie band consisting entirely of flexible materials so as to provide an attractive but inexpensive clothing accessory that can be carried conveniently in a coat pocket or the like when not in use.

The structure of the tie band of the present invention will become clear from the description below in relation to the drawings in which:

FIG. 1 is a front perspective view showing the tie band of the present invention in use;

FIG. 2 is a perspective view showing the parts of the present invention and their relation to the shirt and tie that are shown lines; and, FIG. 3 is a perspective view showing an alternative embodiment of the tie band of the present invention.

As best seen in FIG. 1, the tie band 10 of the present invention permits an emblem 20 to be displayed in front of the necktie 6 while at the same time keeping the necktie 6 laterally centered with respect to the shirt 4.

As shown in FIG. 2, the tie band in a preferred embodiment includes a hidden patch 12 that includes portions defining a buttonhole 14. The hidden patch 12 is attached to an existing shirt button after the shirt has been buttoned. In the preferred embodiment, the hidden patch 12 is composed of a fabric similar to the fabric of the shirt 4.

A band 16 of a flexible material is attached to the hidden patch 12. In the preferred embodiment, the band 16 passes through a hem formed by the stitches 22. In the preferred embodiment the band 16 is a cable of metallized threads, but in an alternative embodiment the band 16 is a chain. In other embodiments, the band 16 may be any flexible material, allowing for a variety in texture, width, and color. The band 16 must be long enough to encircle the tie 6 without gathering it.

The display patch 20 is attached to the band 16 diametrically opposite the hidden patch 12. In the preferred embodiment, the display patch 18 consists of a fabric embroidered with an emblem 20. In an alternative embodiment the display patch may also include a backing of interface material to add stiffness to it. The display patch may be secured to the band 16 by passing the band between the patch and the backing before stitching the patch to the backing.

After the hidden patch has been attached to the button 8, the free end of the tie 6 is passed through the band 16 so that the display patch 18 will be visible in front of the tie 6 as shown in FIG. 1.

FIG. 3 shows an alternative embodiment in which the display patch 18 is omitted.

Although the tie band of the present invention functions to keep the tie centered laterally and to hold the tie adjacent the front of the shirt, its most distinguishing characteristic is that it facilitates the display of an emblem.

Thus, there has been described a tie band with a display that should prove to be useful to social, fraternal, civic, political, religious, academic, athletic, business, and professional organizations to permit members of the group to recognize other members and to display the group's emblem.

Furthermore, the tie band can be used to display the emblem or logo in accurate colors of a professional baseball team or any other professional or amateur team. It can also be used to display a favorite coin, a flag, a bird or animal, or any other item that can be placed on a patch.

What is claimed is:

1. A tie band that can be attached to a button on the front of a shirt for holding a necktie of the four-in-hand type in a laterally-central position against the front of the shirt while also displaying an emblem in front of the necktie, said tie band comprising:

a hidden generally planar patch of a flexible material including portions defining a buttonhole at one end thereof, whereby said hidden patch can be fastened to the button on the front of the shirt, and a loop at the other end thereof;

a band of a flexible material slidably attached within said loop of said hidden patch and long enough to encircle the necktie without gathering it, whereby the necktie is held against the shirt in a laterally-central position and in front of said hidden patch; and, a display patch bearing the emblem to be displayed, and attached to said slidable band diametrically opposite said hidden patch so as to be disposed in front of the necktie.

2. The tie band of claim 1 wherein said hidden patch is composed of a fabric.

3. The tie band of claim 1 wherein said band is composed of metallized threads.

4. The tie band of claim 1 wherein said band is composed of a fabric.

* * * * *